US012509821B2

(12) United States Patent
MacMeccan et al.

(10) Patent No.: US 12,509,821 B2
(45) Date of Patent: Dec. 30, 2025

(54) PRINTED TEXTILE SUBSTRATE AND PROCESS FOR MAKING

(71) Applicant: Milliken & Company, Spartanburg, SC (US)

(72) Inventors: Robert M. MacMeccan, Greer, SC (US); Jonathan C. McCay, LaGrange, GA (US); Tammy B. Harris, Valley, AL (US); Kevin D. West, LaGrange, GA (US); Dale S. Kitchen, Boiling Springs, SC (US); Jonathan Rosen, Greenville, SC (US); Scott R. Parry, Spartanburg, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 18/403,839

(22) Filed: Jan. 4, 2024

(65) Prior Publication Data

US 2024/0240396 A1 Jul. 18, 2024

Related U.S. Application Data

(60) Provisional application No. 63/438,631, filed on Jan. 12, 2023.

(51) Int. Cl.

| | |
|---|---|
| ***B41J 3/407*** | (2006.01) |
| ***D06N 7/00*** | (2006.01) |
| ***D06P 5/30*** | (2006.01) |

(52) U.S. Cl.

CPC ..... *D06P 5/30* (2013.01); *D06N 7/0063* (2013.01)

(58) Field of Classification Search

CPC ..... D06N 7/0063; D06P 5/30

See application file for complete search history.

(56) References Cited

U.S. PATENT DOCUMENTS

| | | | |
|---|---|---|---|
| 5,983,952 | A | 11/1999 | Carpenter |
| 9,332,870 | B1 | 5/2016 | Burgess |
| 10,988,942 | B2 | 4/2021 | Thiers |
| 2002/0024544 | A1 | 2/2002 | Codos |
| 2014/0212618 | A1 | 7/2014 | Mcbride |
| 2019/0350437 | A1 | 11/2019 | Love |

(Continued)

FOREIGN PATENT DOCUMENTS

| | | | |
|---|---|---|---|
| CA | 2062991 | | 9/1992 |
| CN | 102673177 | A | 9/2012 |
| CN | 103434290 | A | 12/2013 |

(Continued)

OTHER PUBLICATIONS

International Search Report and Written Opinion issued in App. No. PCT/US2024/010683, dated Jul. 4, 2024, 12pages.

(Continued)

*Primary Examiner* — Christopher E Mahoney
*Assistant Examiner* — Marissa Ferguson-Samreth
(74) *Attorney, Agent, or Firm* — Brenda D. Amidon

(57) ABSTRACT

This invention relates to a printed textile substrate, such as a floorcovering article, and a process for making a printed textile substrate. This invention provides the process and steps to print color patterns in-register with physical patterns, such as varying yarn pile heights, yarn luster, yarn color, and the like. This process provides many unique aesthetics on a textile substrate that cannot be created another way.

3 Claims, 9 Drawing Sheets

(56) References Cited

U.S. PATENT DOCUMENTS

2021/0238785 A1* 8/2021 Burgess ..... A47G 27/025

FOREIGN PATENT DOCUMENTS

| | | | |
|---|---|---|---|
| CN | 103552389 | A | 2/2014 |
| CN | 103866551 | A | 6/2014 |
| JP | 3260453 | B2 | 2/2002 |
| WO | 0121878 | A1 | 3/2001 |

OTHER PUBLICATIONS

International Search Report and Written Opinion issued in App. No. PCT/US2024/010684, dated Jul. 4, 2024, 12 pages.
International Search Report and Written Opinion issued in App. No. PCT/US2024/010687, dated Jul. 4, 2024, 13 pages.
International Search Report and Written Opinion issued in App. No. PCT/US2024/010690, dated Jul. 4, 2024, 13 pages.
International Search Report and Written Opinion issued in App. No. PCT/US2024/010693, dated Jul. 4, 2024, 12 pages.
McKerrow, Phillip J., and Bjorn E. Kristiansen. "Classifying surface roughness with CTFM ultrasonic sensing." IEEE Sensors Journal 6.5 (2006): 1267-1279.
Pappas, Thrasyvoulos N., et al. "Image analysis: Focus on texture similarity." Proceedings of the IEEE 101.9 (2013): 2044-2057.

* cited by examiner

--PRIOR ART--

--PRIOR ART--

--PRIOR ART--

DESIGN PROCESS A - PCX FILE LAYERED WITH PRINT SRX FILE FOR SOLID COLOR PLACEMENT.
THE PRINT DESIGN WILL MATCH A SOLID COLOR TO THE PCX FILE'S CODES (PILE SETTINGS).

DESIGN PROCESS B - PCX FILE LAYERED WITH PRINT SRX FILE FOR TEXTURE AND COLOR PLACEMENT.
THE PRINT DESIGN WILL MATCH A TEXTURED PATTERN AND COLOR TO THE PCX FILES CODES (PILE SETTINGS).

PRINTED TEXTILE SUBSTRATE AND PROCESS FOR MAKING

CROSS REFERENCE TO RELATED APPLICATIONS

This application claims priority to U.S. Provisional Patent Application No. 63/438,631, entitled "Printed Textile Substrate and Process For Making," which was filed on Jan. 12, 2023, and is entirely incorporated by reference herein.

TECHNICAL FIELD

This invention relates to a printed textile substrate, such as a floorcovering article, and a process for making a printed textile substrate. This invention provides the process and steps to print color patterns in-register with physical patterns, such as varying yarn pile heights, yarn luster, yarn color, and the like. This process provides many unique aesthetics on a textile substrate that cannot be created another way.

BACKGROUND

Printed textile substrates, such as floorcovering articles, have been historically dyed and/or printed via several printing processes in order to create unique patterns and/or designs on the surface thereof. In some instances, textile substrates are printed using a fluid dyer wherein the substrate, such as a carpet tile, is submerged within a dye bath to create a solid color shade on the surface of the substrate. The dyed substrate may then be subjected to a second pass down the manufacturing range in order to overprint a design on its surface using printing inks. Alternatively, textile substrates may be printed with a digital printing machine that uses printing inks in order to make a pattern and/or design on the surface of the substrates. In yet another instance, solution dyed yarn is used to manufacture the textile substrate and then a pattern may be printed on its surface using printing inks.

Despite all these options for printing textile substrates and creating various patterns and/or designs thereon, consumer driven demand for heretofore never before seen patterns and/or designs continues to grow. Manufacturers and designers alike are thus challenged with providing new technology that is capable of achieving these results in a cost-effective, environmentally friendly, and sustainable manner.

Accordingly, further improvements in the printing of textile substrates, such as floorcovering articles, are needed in order to provide new and interesting designs that have never before been achieved due to limitations in technology. Printing in-register with various detectable and recognizable physical features of a textile substrate (such as a tufted textile substrate) has not been successfully realized due to the problems associated with bow and skew of the substrate (e.g. stretching and movement) during manufacture, as well as shrinking of the textile substrate, and other manufacturing issues. Alignment and/or registration detail of a desired pattern may also be lost or reduced upon visual inspection due to the cutting process for making carpet tiles from larger rolls of carpet. Thus, technological advances in the area of digital printing machinery are needed in order to successfully address these issues and achieve new patterns and/or designs on textile substrates.

The present invention addresses these problems and provides the solution to achieving print in-register designs and patterns on the surface of textile substrates, as will be described herein. The utilization of several new process steps and technological advances solves the problems associated with the previous inability to achieve in-register printing on a textile substrate. It further provides a print in-register textile substrate, achievable with a digital printing machine, that contains patterns and/or designs on the substrate that were previously unattainable.

BRIEF SUMMARY

In one aspect, the invention relates to a textile substrate comprised of tufted yarns, said tufted yarns forming at least two areas A1 and A2 within the textile substrate, said areas A1 and A2 each containing a tufted design, said area A1 containing a first tufted design TD1 and said area A2 containing a second tufted design TD2, said TD1 being different from TD2, said at least two areas A1 and A2 being further characterized by having one of the following:

(a) a print composition on at least a portion of area A1,
(b) a print composition on at least a portion of area A2, or
(c) a print composition on a least a portion of both area A1 and area A2, said textile substrate designed to be affixed to a building surface.

In another aspect, the invention relates to a method for providing a pattern on a textile substrate, said method comprising the following steps:

(a) providing a textile substrate comprised of tufted yarns, said tufted yarns forming at least two areas A1 and A2 within the textile substrate, said areas A1 and A2 each containing a tufted design, said area A1 containing a first tufted design TD1 and said area A2 containing a second tufted design TD2, said TD1 being different from TD2;
(b) providing a digital printing apparatus; and
(c) printing the textile substrate with the digital printing apparatus in a pre-determined location to form a pattern on the textile substrate by applying a print composition to the surface of the textile substrate, said print composition being applied to only one of the following pre-determined locations on the textile substrate:
  (i) on at least a portion of area A1,
  (ii) on at least a portion of area A2, or
  (iii) on a least a portion of both area A1 and area A2,
said printing being characterized as being in-register with the pre-determined location selected from (i) to (iii) on the textile substrate.

In a further aspect, the invention relates to a process for creating a design on a textile substrate comprising the following steps:

(a) selecting a textile substrate, wherein the textile substrate contains tufted yarns having a first height, tufted yarns having a second height, and areas free from tufted yarns, wherein the first height is greater than the second height;
(b) selecting a print design to be placed on a surface of the textile substrate in a pre-determined location, wherein the print design is applied to the textile substrate via a digital printing apparatus, and wherein the print design is applied to the textile substrate in only one of the following pre-determined locations on the textile substrate:
  (i) on at least a portion of the tufted yarns having a first height,
  (ii) on at least a portion of the tufted yarns having a second height, (iii) on a least a portion of the areas free from tufted yarns, or (iv) on a least a portion of the tufted yarns having a first height and a second height;

and;

(c) directing the digital printing apparatus to apply the pre-selected print design to the textile substrate.

In a further aspect, the invention relates to a process for creating a design on a textile substrate comprising the following steps:

(a) selecting a textile substrate, wherein the textile substrate contains tufted yarns having a first height, tufted yarns having a second height, and areas free from tufted yarns, wherein the first height is greater than the second height;

(b) selecting a first print design to be placed on a surface of the textile substrate in a pre-determined location, wherein the first print design is applied to the textile substrate via a digital printing apparatus, and wherein the first print design is applied to the textile substrate in only one of the following pre-determined locations on the textile substrate:

(i) on at least a portion of the tufted yarns having a first height, (ii) on at least a portion of the tufted yarns having a second height, (iii) on a least a portion of the areas free from tufted yarns, or (iv) on a least a portion of the tufted yarns having a first height and a second height;

(c) directing the digital printing apparatus to apply the pre-selected first print design to the textile substrate;

(d) selecting a second print design to be placed on the surface of the textile substrate, wherein the second print design is applied to the textile substrate via a digital printing apparatus, and wherein the second print design is applied to the textile substrate in only one of the following pre-determined locations on the textile substrate:

(i) on at least a portion of the tufted yarns having a first height, (ii) on at least a portion of the tufted yarns having a second height, (iii) on a least a portion of the areas free from tufted yarns, or (iv) on a least a portion of the tufted yarns having a first height and a second height; and (e) directing the digital printing apparatus to apply the pre-selected second print design to the textile substrate.

In another aspect, the invention relates to a process for creating a design on a textile substrate comprising the following steps:

(a) selecting a textile substrate, wherein the textile substrate contains tufted yarns having a first height, tufted yarns having a second height, and areas free from tufted yarns, wherein the first height is greater than the second height;

(b) selecting a first print design to be placed on a surface of the textile substrate in a pre-determined location, wherein the first print design is applied to the textile substrate via a digital printing apparatus, and wherein the first print design is applied to the textile substrate in only one of the following pre-determined locations on the textile substrate:

(i) on at least a portion of the tufted yarns having a first height, (ii) on at least a portion of the tufted yarns having a second height, (iii) on a least a portion of the areas free from tufted yarns, or (iv) on a least a portion of the tufted yarns having a first height and a second height;

(c) directing the digital printing apparatus to apply the pre-selected first print design to the textile substrate;

(d) selecting a second print design to be placed on the surface of the textile substrate, wherein the second print design is applied to the textile substrate via a digital printing apparatus, and wherein the second print design is applied to the textile substrate in only one of the following pre-determined locations on the textile substrate:

(i) on at least a portion of the tufted yarns having a first height, (ii) on at least a portion of the tufted yarns having a second height, (iii) on a least a portion of the areas free from tufted yarns, or (iv) on a least a portion of the tufted yarns having a first height and a second height;

(e) directing the digital printing apparatus to apply the pre-selected second print design to the textile substrate;

(f) selecting a third print design to be placed on the surface of the textile substrate, wherein the third print design is applied to the textile substrate via a digital printing apparatus, and wherein the third print design is applied to the textile substrate in only one of the following pre-determined locations on the textile substrate:

(i) on at least a portion of the tufted yarns having a first height, (ii) on at least a portion of the tufted yarns having a second height, (iii) on a least a portion of the areas free from tufted yarns, or (iv) on a least a portion of the tufted yarns having a first height and a second height; and (g) directing the digital printing apparatus to apply the pre-selected third print design to the textile substrate.

In yet another aspect, the invention relates to a textile substrate comprising a pattern, said pattern characterized by having at least one area containing physical cues and at least one area free from physical cues, said physical cues being selected from print composition, tufting density, yarn construction, yarn composition, and combinations thereof, said pattern further characterized by having only one of the following:

(a) printing ink on at least a portion of the area containing physical cues, (b) printing ink on a least a portion of the area free from physical cues, or (c) printing ink on a least a portion of the area containing physical cues and the area free from physical cues, said textile substrate designed for use on a horizontal surface.

In a further aspect, the invention relates to a textile substrate comprising a pattern, said pattern characterized by having at least one area containing a first physical cue and at least one area containing a second physical cue, said physical cues being selected from print composition, tufting density, yarn construction, yarn composition, and combinations thereof, said pattern further characterized by having only one of the following:

(a) Printing Ink A, B, or C on at least a portion of the area containing the first physical cue,
(b) Printing Ink A, B or C on a least a portion of the area having the second physical cue, or
(c) Printing Ink A, B, or C on a least a portion of the area containing both the first and the second physical cues,
said textile substrate designed for use on a horizontal surface.

In yet another aspect, the invention relates to a textile substrate comprising a pattern, said pattern characterized by having at least one topographical area containing tufted yarns of a first height and of a second height, wherein said first height is greater than said second height, said pattern further characterized by having only one of the following:
(a) Printing Ink A, B or C on at least a portion of the tufted yarns having a first height,
(b) Printing Ink A, B or C on at least a portion of the tufted yarns having a second height, or
(c) Printing Ink A, B or C on a least a portion of the tufted yarns having a first height and a second height,
said textile substrate designed for use on a horizontal surface.

DETAILED DESCRIPTION

Figure 1:
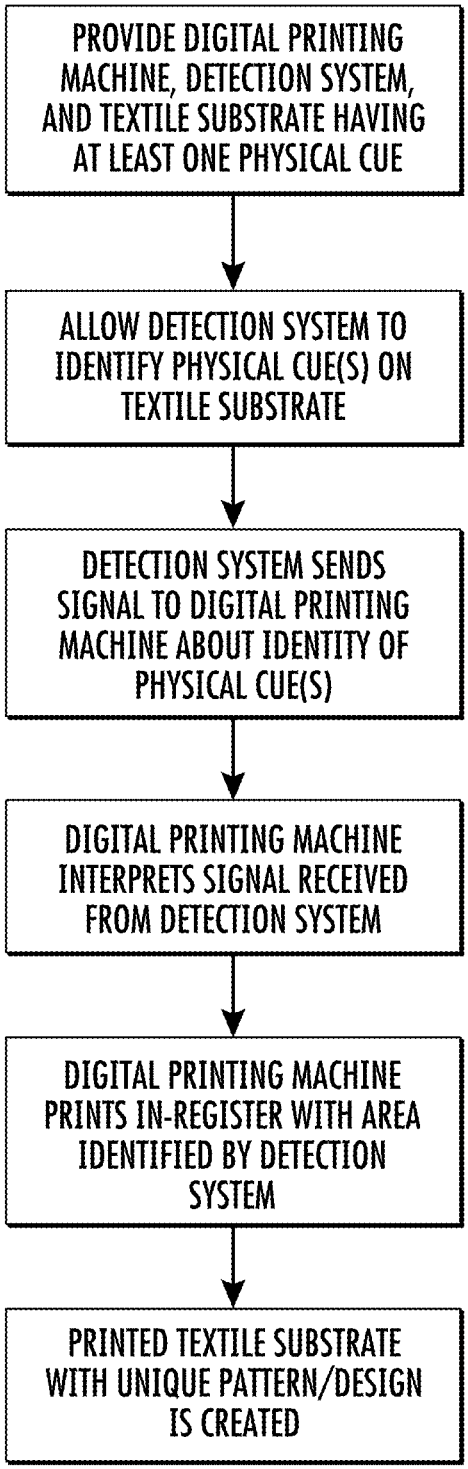
FIG. 1 is a flow diagram illustrating the general steps of the method of the invention.
Figure 2A:
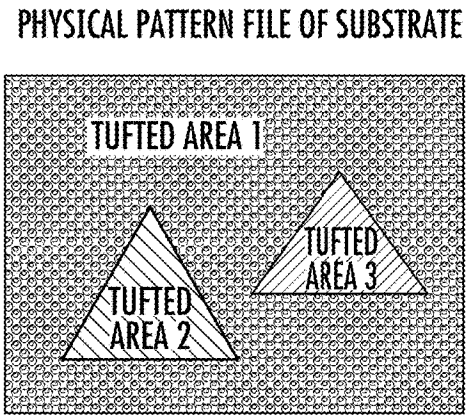
FIG. 2A is a diagram illustrating one embodiment of a physical file of a textile substrate that contains Tufted Area 1, Tufted Area 2, and Tufted Area 3.
Figure 2B:
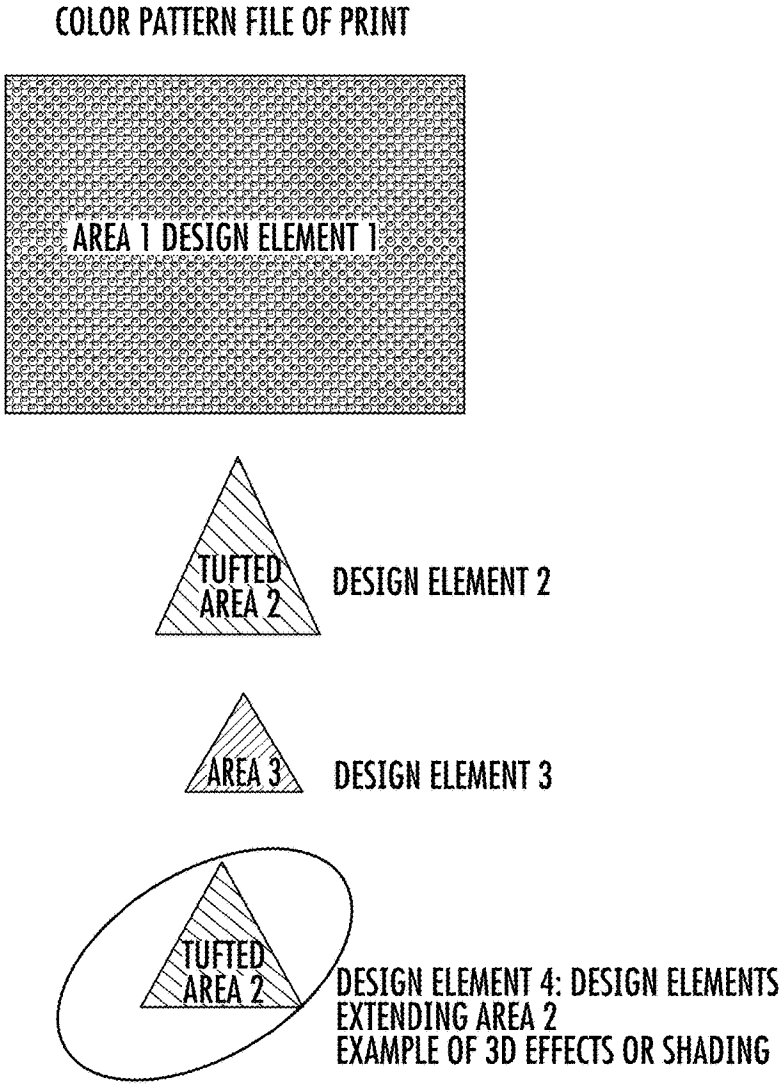
FIG. 2B is a diagram illustrating one embodiment of a color pattern file of print that shows Design Element 1 in combination with Tufted Area 1, Design Element 2 in combination with Tufted Area 2, Design Element 3 in combination with Tufted Area 3, and Design Element 4 in combination with Tufted Area 2.
Figure 2D:
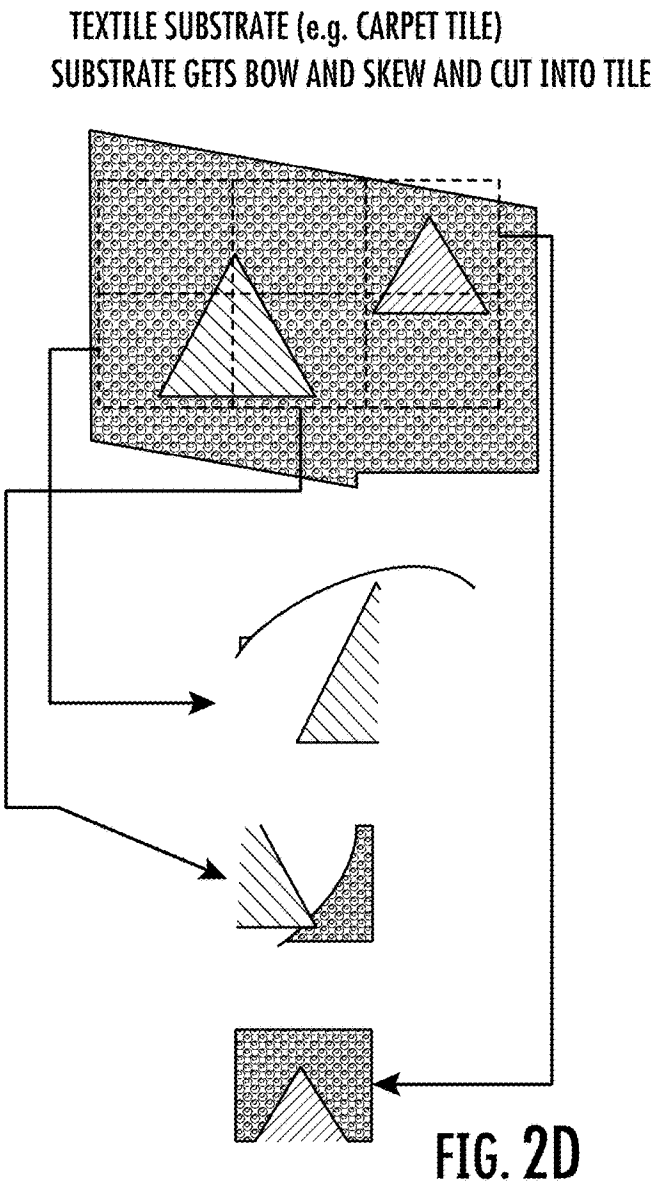
FIG. 2D is a diagram illustrating the embodiment of FIG. 2B applied to a textile substrate, such as carpet tile, and the challenges presented with bow and skew in achieving proper alignment of print design along with challenges of cutting the tile and losing some design/registration detail when cut into smaller pieces.
Figure 2C:
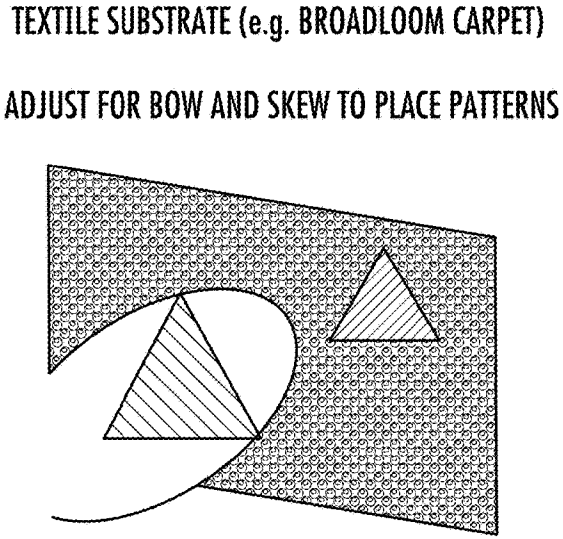
FIG. 2C is a diagram illustrating the embodiment of FIG. 2B applied to a textile substrate, such as broadloom carpet, and the challenge presented with bow and skew in achieving proper alignment of print design.

As used herein, "digital printing machine" refers to a computer controlled apparatus that emits printing ink onto the surface of a textile substrate, and may also be referred to herein as a "jet dyeing apparatus" and/or "digital printing apparatus."

The term "floorcovering article," as used herein, is intended to describe a textile substrate which comprises face fibers and which is utilized to cover surfaces on which people are prone to walk. Thus, carpets (broadloom, tile, or otherwise) and floor mats (outdoor, indoor, and the like) are specific types of floorcovering articles.

The term "printing," as used herein, refers to the process whereby the color of a fiber or yarn is changed, either in whole or in part, by printing ink emitted from a jet dyeing apparatus or digital printing machine (e.g., the final color of the fiber or yarn is different from the initial color).

The present invention allows for the creation of unique aesthetics on the surface of a textile substrate that includes graphics effects in-register to texture, antique effects, shadowing and 3-dimensional effects, and the like, as shown in Table 1.

TABLE 1

| Various Exemplary In-Register Aesthetic Effects<br>Exemplary Aesthetic Effects Achieved |
|---|
| Solid colors on different pile heights |
| Accent tufted elements |
| Gradient color on high areas versus near-solid color on low areas |
| 3-dimensional effects |
| Different texture on high and low areas |
| Different color strength on high versus low (washed out on background and strong on high areas; eliminate dye pooling on low areas) |
| In-register printing on low areas and gradient printing on high areas |
| More figurative design elements on tufted patterned high areas and detailed background on low areas |
| Assign design element or super pixel to only 1 part of a larger 4 × 2 m tufted pattern |
| Broadloom, flood shade and print to tufted pattern with different wet-outs on high and low areas |
| Antique shade carpet just off the high areas to create effect |
| Tile: in-register print pattern to tile in one area, then not in-register in second area |

These aesthetic features may be applied to any textile substrate that contains detectable physical cues, such as for example, floorcovering articles (including broadloom carpet and carpet tile), upholstery fabrics, wallcovering fabrics, and the like. In one aspect, the invention allows at least a portion of a design to be in-register to a carpet tile, simulating either broadloom (no seams) or tile (has seams) with other design elements that are also in-register to a tufted pattern. When used as floorcovering, unique floor plans and multi-tile medallion designs can be created. Layering the features of the invention across many carpet tiles even allows for the creation of large designs on a scale that was previously not realized.

The invention also allows control of different amount of dye to different yarn types and pile height, which controls color, pooling and/or and bleeding more effectively in the printed design. Control is generally based on identification of physical features of the yarns detected by a digital printing machine.

The general steps for creating the printed textile substrate of the present invention involve selection of a design that includes a textile pattern (such as a tuft pattern) and at least one additional feature such as different tuft heights, yarn luster, yarn color, and the like. These general steps are typically carried out by a person skilled in the art of print design. After these selections are made, the designer utilizes software to instruct a digital printing machine to produce the desired print pattern on the textile substrate.

In one aspect of the invention, the following process steps are carried out:

(a) design software reads the physical pattern file,
(b) design software converts resolution of tufted design file to the physical resolution of the tufting machine,
(c) design software assigns dimensions to the tufted pattern file,
(d) design software assigns physical pattern file into distinct design layers (e.g., pile heights),
(e) designer combines or splits physical layers as needed,
(f) designer adds additional print layers that are independent of the physical layers,
(g) designer assigns color pallet to each layer (this may be color composition and/or amount of color),
(h) design software converts designs to resolution of printer,
(i) design software outputs layers wherein one layer corresponds to the color and one layer corresponds to the tufted pattern,
(j) machine reads each physical substrate's tufted pattern (accomplished via detection system or cutting/labeling of the substrate),
(k) machine determines the physical pattern on the tile and relation to the tufted textile substrate (this may include correction for offset, bow, skew, and the like, of the actual textile substrate compared with the tufted pattern),
(l) machine mathematically combines the color layers and tufted layer into a file format that corresponds to the actual physical textile substrate (this may include combining and/or stretching/rotating the color layers to the tufted pattern), and
(m) machine uses color profiles to print the textile substrate with the design information provided.

Variations of embodiments shown in FIGS. 2A to 2D include one or more of the following:

Design Element 1 could be solid;
Design Element 1 could be a reduced ink put-down solid;
Design Element 1 could be designs and/or patterns created according to U.S. Pat. Nos. 8,145,345; 8,655,473; 9,060,623 all to McCay et al.;
Design Element 1 could be designs and/or patterns created according to U.S. Pat. Nos. 8,155,776; 8,644,976; 9,066,614 all to Bittner et al., in-register with the tile/roll good;
Design Element 1 could be a combination of different design elements (e.g. layers);
Design Element 4 could be in-register with the tufted pattern;
Design Element 4 could be in-register with the tile at the edges even though Tufted Area 3 is not in-register with the tile;
Any design elements could be metapixel blends as taught in U.S. Pat. No. 6,911,245 to Beistline et al. and/or U.S. Pat. No. 6,793,309 to McCay et al.;
Any design elements could be superpixels as taught in U.S. Pat. No. 6,911,245 to Beistline et al. and/or U.S. Pat. No. 6,793,309 to McCay et al.;
The different design element layers could be selected from different color pallets;
A medallion can be created wherein portions of the design are in-register to the tile independent of the tufting pattern, and positions of the color design are related to the position in the tufted pattern medallion.

The present invention utilizes a digital printing machine, or jet dyeing apparatus, to print colors, patterns and/or designs on the surface of a textile substrate in-register (or in relation to or based on) the location of other detectable physical features present on or in the textile substrate. The textile substrate may be one that comprises a pile substrate, such as a floorcovering article. In one aspect, the floorcovering article may be a carpet tile. The textile substrate may also comprise at least one portion having tufted yarns present therein.

Figure 3:
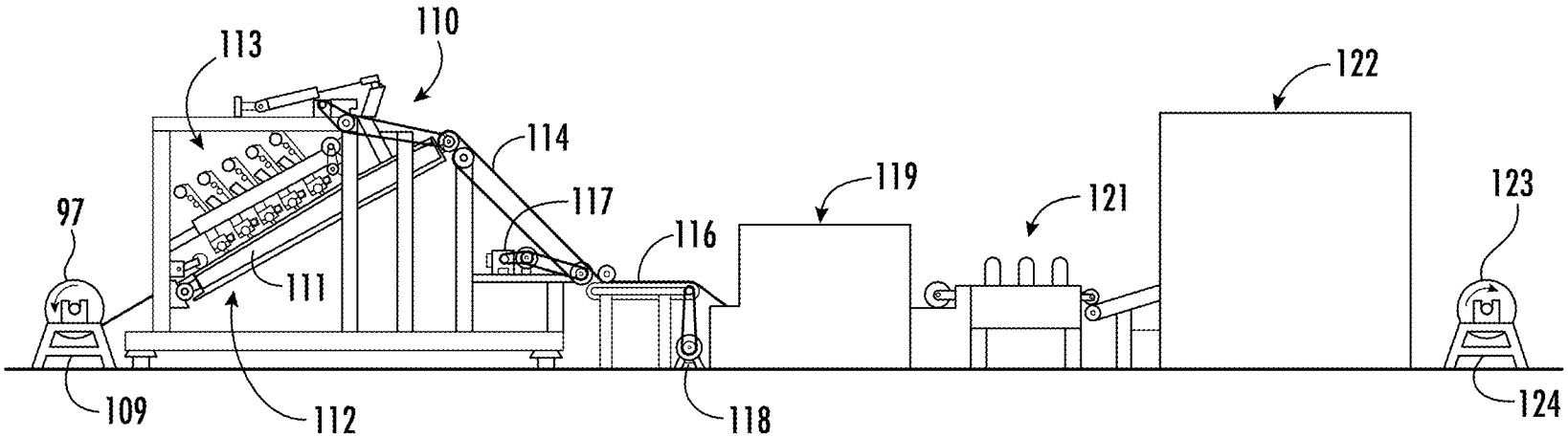
FIG. 3 is a schematic representation of an exemplary jet dyeing apparatus for applying dye to textile substrates according to the present invention.

An exemplary jet dyeing apparatus suitable for use in the present invention for pattern dyeing a textile substrate, such as a floorcovering article having a pile surface, is depicted in FIG. 3. Supply roll 97 is mounted on a suitable support 109 for supplying a roll of, for example, broadloom carpet. Alternatively, if carpet tiles are being printed, they may be arranged on the conveyor using a vacuum apparatus capable of suction movement of tiles. The floorcovering article is next advanced through dyeing apparatus 110 as follows. The floorcovering article is advanced onto the lower end of inclined conveyor 111 of jet applicator section 112, where the article is printed by a programmed operation of a plurality of jet gun bars, generally indicated at 113, which inject streams of dye onto the face surface (or pile surface) of the floorcovering article during its passage thereunder. The pattern dyed floorcovering article leaving the applicator section is moved by conveyors 114 and 116, driven by motors 117 and 118 to steam chamber 119 where the article is subjected to a steam atmosphere to fix the dyes thereon. The dyed floorcovering article leaving steam chamber 119 is conveyed through a water washer 121 to remove excess unfixed dye from the article. Thereafter, the washed floorcovering article is passed through a hot air dryer 122 to take up roll 123 which is mounted on a suitable support 124. Alternatively, for the printing of carpet tiles, the carpet tiles are removed from the conveyor after leaving hot air dryer 122 and are stacked and prepared for shipment.

Figure 4:
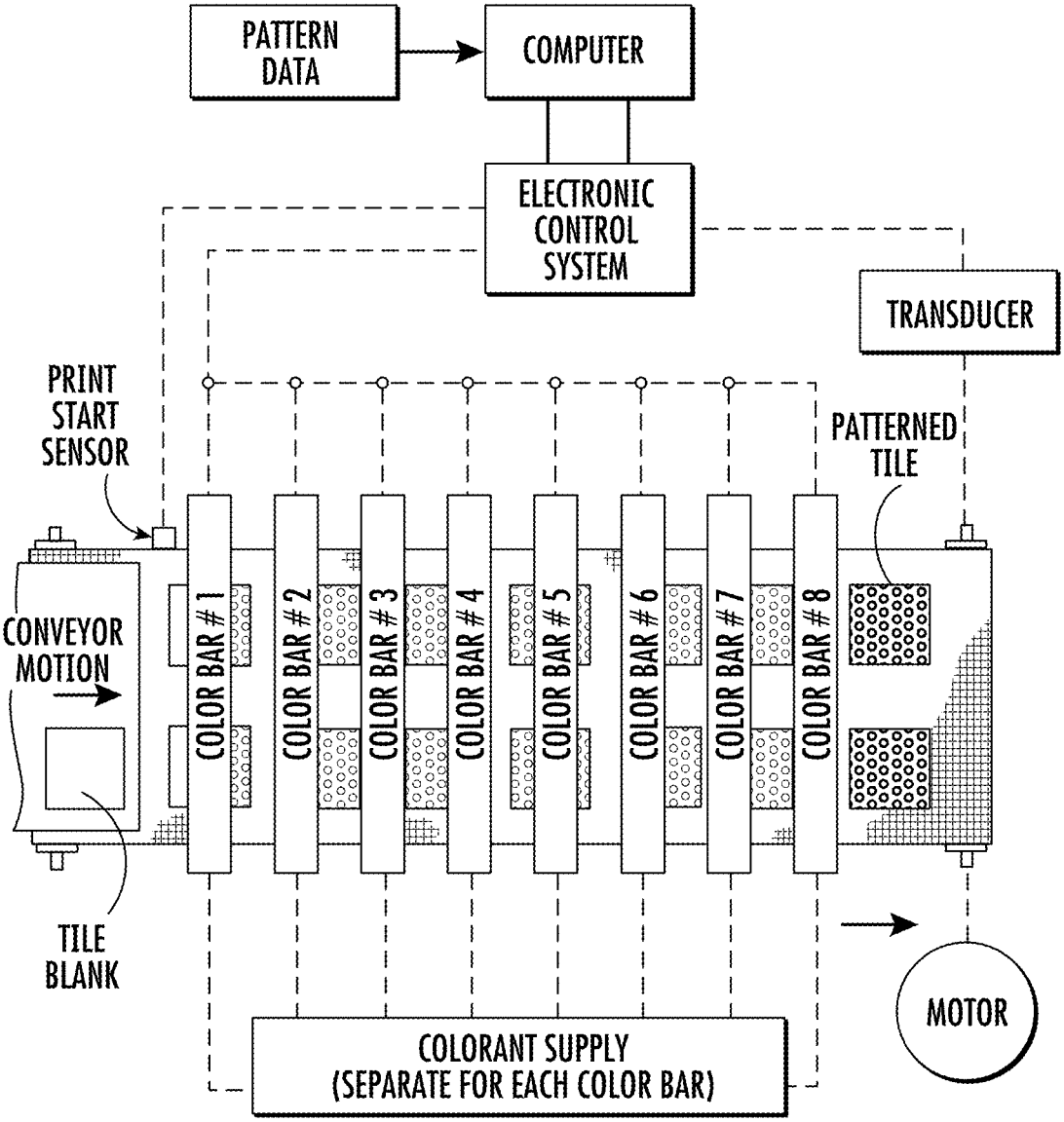
FIG. 4 is a schematic representation of carpet tiles in relation to the jet dye applicator gun bar section of an exemplary jet dyeing apparatus.

FIG. 4 illustrates in greater detail the process by which carpet tiles are passed under a series of color bars, or gun bars, that emit printing ink on the surface of the tiles thereby providing a printed carpet tile. Printing ink or dyes are contained within each of the color bars until a signal is received from the electronic control system which causes a particular color bar to dispense or drop the ink onto the surface of the floorcovering article. Further details of the jet dyeing apparatus are described, for example, in U.S. Pat. No. 3,939,675 to Klein and U.S. Pat. No. 4,740,214 to McBride et al.

The printing ink emitted from the digital printing machine, or jet dyeing apparatus, contains at least one dye. Dyes may be selected from acid dyes, direct dyes, reactive dyes, cationic dyes, disperse dyes, and mixtures thereof. Acid dyes include azo, anthraquinone, triphenyl methane and xanthine types. Direct dyes include azo, stilbene, thiazole, dioxsazine and phthalocyanine types. Reactive dyes include azo, anthraquinone and phthalocyanine types. Cationic dyes include thiazole, methane, cyanine, quinolone, xanthene, azine, and triaryl methine. Disperse dyes include azo, anthraquinone, nitrodiphenylamine, naphthal imide, naphthoquinone imide and methane, triarylmethine and quinoline types.

Specific dye selection will depend upon the type of fiber and/or fibers comprising the textile substrate that is being printed. For example, in general, a disperse dye may be used to print polyester or acetate fibers. However, anionic dyes, direct dyes, acid dyes, reactive dyes, and mixtures thereof may be used to print fibers made from wool, silk, polyamide, cotton, and rayon. For materials made from acrylic fiber and cationic dyeable polyester fiber, cationic dyes may be used.

As illustrated in FIG. 4, the printing apparatus contains many color bars. Typically, some will contain dyes that include a viscosity modifier in large amounts, while others, will contain zero amount, or very small amounts, of viscosity modifiers. Viscosity modifiers typically include any material that, when added to an aqueous medium, increases the viscosity of the aqueous medium.

Suitable viscosity modifiers that may be utilized include known natural water-soluble polymers such as polysaccharides, such as starch substances derived from corn and wheat, gum arabic, locust bean gum, tragacanth gum, guar gum, guar flour, polygalactomannan gum, xanthan, alginates, and a tamarind seed; protein substances such as gelatin and casein; tannin substances; and lignin substances. Examples of the water-soluble polymer further include synthetic polymers such as known polyvinyl alcohol compounds and polyethylene oxide compounds. Mixtures of the aforementioned viscosity modifiers may also be used. Viscosity is often measured in units of centipoise at 25° C., using a Brookfield Viscometer Model LVF, spindle No. 2 at 6 rpm.

Digital printing machines useful in the present invention typically contain a plurality of print heads. In one aspect of the invention, each print head may contain a specific chemical composition. These print head chemical compositions may be dye-containing or non-dye containing. The chemical composition may be chromophore-containing or free from chromophore(s). The print head chemical composition may contain at least one wetting agent, with or without dye(s) and/or chromophore(s). In instances wherein the print head is free from chromophore (i.e., the print head contains a chromophore-free print ink), the chemical composition contained therein may be colorless. The chemical composition of each print head may be the same or may be different from the other print heads. In other words, print head specific chemistry may be utilized to provide additional patterns and/or designs to the textile substrate printed thereon. For example, different dyes, dye formulations, and viscosities, as well as wetting chemistries, may be present in various print heads that are used to target in-register features (such as certain tufts like high loops) on the textile substrate to create unique designs. In one aspect of the invention, print technology as taught in US Patent Application Pub. No. 2014/0212618 A1 to McBride et al. may be useful for incorporation into the present invention. Additionally, a drop-on-demand printing apparatus may also be utilized for carrying out the present invention.

Textile substrates suitable for use in the present invention include, without limitation, fabrics (such as those used for upholstery and wall covering) and floorcovering articles. Fabrics may be formed from fibers such as synthetic fibers, natural fibers, or combinations thereof. Synthetic fibers include, for example, polyester, acrylic, polyamide, polyolefin, polyaramid, polyurethane, regenerated cellulose (e.g., rayon), and blends thereof. The term "polyester" is intended to describe a long-chain polymer having recurring ester groups (—C(O)—O—). Examples of polyesters include aromatic polyesters, such as polyethylene terephthalate (PET), polytriphenylene terephthalate, polytrimethylene terephthalate (PTT), and polybutylene terephthalate (PBT), and aliphatic polyesters, such as polylactic acid. Polyamide includes, for example, nylon 6; nylon 6,6; nylon 1,1; and nylon 6,10; and combinations thereof. Polyolefin includes, for example, polypropylene, polyethylene, and combinations thereof. Polyaramid includes, for example, poly-p-phenyleneteraphthalamid (i.e., Kevlar®), poly-m-phenyleneteraphthalamid (i.e., Nomex®), and combinations thereof. Natural fibers include, for example, wool, silk, cotton, flax, and blends thereof.

The fabric may be formed from fibers or yarns of any size, including microdenier fibers and yarns (fibers or yarns having less than one denier per filament). The fibers or yarns may have deniers that range from less than about 1 denier per filament to about 2000 denier per filament or more preferably, from less than about 1 denier per filament to about 500 denier per filament, or even more preferably, from less than about 1 denier per filament to about 300 denier per filament. Furthermore, the fabric may be partially or wholly comprised of multi-component or bi-component fibers or yarns which may be splittable along their length by chemical or mechanical action. The fabric may be comprised of fibers such as staple fiber, filament fiber, spun fiber, or combinations thereof. The fabric may be of any variety, including but not limited to, woven fabric, knitted fabric, nonwoven fabric, or combinations thereof, and further including that any of the fabric types may include tufted fabric.

Floorcovering articles, printed according to the invention described herein include, without limitation, woven carpet, knitted carpet, tufted carpet, graphics tufted carpet, stitched on pile carpet, bonded pile carpet, hooked carpet, knotted pile carpet, and the like. The floorcovering articles may be broadloom carpet or carpet tiles. Carpet tiles (i.e., modular carpet) may be of any geometric shape or size as desired for its end-use application. The longitudinal edges of the carpet tiles may be of the same length and width, thus forming a square shape. Or the longitudinal edges of the carpet tiles may have different dimensions such that the width and the length are not the same (e.g., thus forming carpet planks). The floorcovering articles may be of any suitable construction (e.g. hardback, cushion back, etc.). The face may be constructed of any appropriate textile material in yarn or pile form that is suitable for dyeing and patterning, and may have a face height or pile height that is uniform or non-uniform (e.g. may be textured, as found in a multi-level loop pile) created by tufting, needling, flocking, bonding, and the like, or the use of non-woven substrates.

Figure 8:
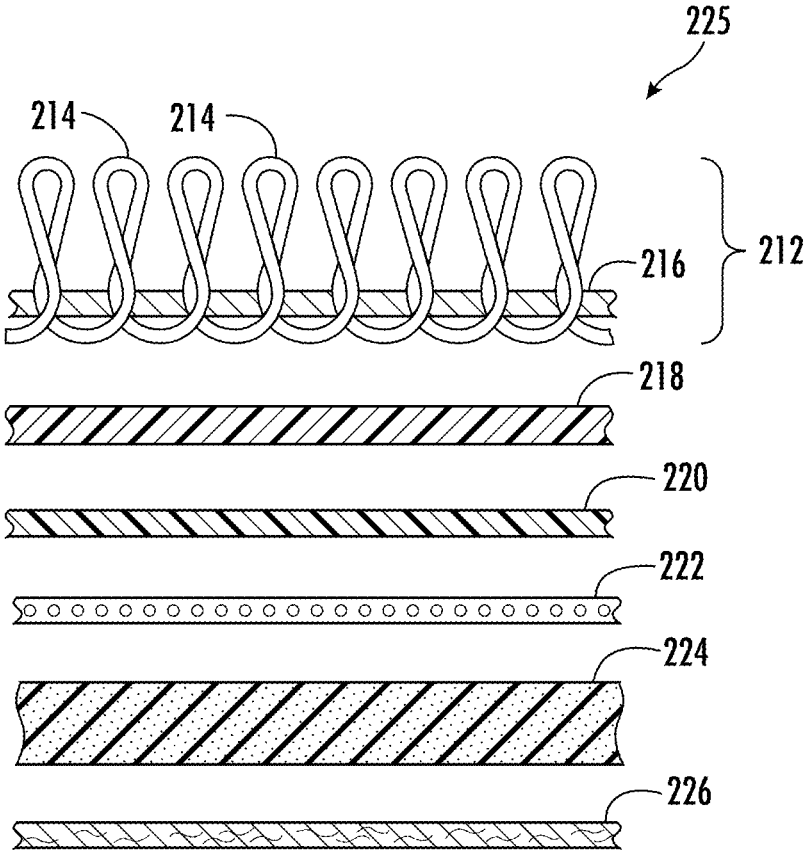
FIG. 8 is an exploded schematic view of an exemplary multi-layered carpet construction.

One exemplary multi-layered carpet construction is shown in FIG. 8. In this exemplary construction, the substrate structure 225 is made up of a primary carpet fabric 212 formed from a plurality of pile yarns 214 tufted through a primary backing layer 216 such as a scrim or nonwoven fibrous textile of polyester, polyamide, and/or polypropylene as will be well known to those skilled in the art. A precoat backing layer 218 of a resilient adhesive such as SBR latex and/or vinyl acetate-ethylene ("VAE") latex is disposed across the underside of the primary carpet fabric 212 so as to hold the pile yarns 214 in place within primary backing layer 216. An adhesive layer 220 such as a hot melt adhesive extends away from the precoat backing layer 218. A layer of stabilizing material 222 such as woven or nonwoven glass is disposed at a position between the adhesive layer 220 and a cushioning layer 224 such as virgin or rebounded polyurethane foam or the like. A secondary backing layer 226 such as a nonwoven blend of polyester and polypropylene fibers is disposed across the underside of the cushioning layer 224.

As will be appreciated, the actual construction of the substrate structure 225 may be subject to a wide range of variations. Accordingly, the multi-layered construction illustrated in FIG. 8 is to be understood as constituting merely an exemplary construction representative of a floorcovering article and that the present invention is equally applicable to any other construction of carpeting and/or other textiles as may be desired. By way of example only, various carpet tile constructions are described in U.S. Pat. Nos. 6,203,881 and 6,468,623.

In the event that the textile substrate is a floorcovering article, the pile yarns 214 may be either spun or filament yarns formed of natural fibers such as wool, cotton, or the like. The pile yarns 214 may also be formed of synthetic materials such as polyamide polymers including nylon 6 or nylon 6,6; polyesters such as PET and PBT; polyolefins such as polyethylene and polypropylene; rayon; and polyvinyl polymers such as polyacrylonitrile. Blends of natural and synthetic fibers such as blends of cotton, wool, polyester and nylon may also be used within the pile yarns 214. In FIG. 8, the pile yarns 214 are illustrated in a loop pile construction. Of course, it is to be understood that other pile constructions as will be known to those of skill in the art including cut pile constructions and the like may likewise be used.

Floorcovering articles may have a fiber face weight in the range from about 1 to about 75 ounces/square yard, or in the range from about 5 to about 60 ounces/square yard, or in the range from about 10 to about 55 ounces/square yard, or in the range from about 20 to about 50 ounces/square yard, or even in the range from about 12 to about 40 ounces/square yard.

The material comprising the textile substrate, for example, the pile surface of a floorcovering article, may be synthetic fiber, natural fiber, man-made fiber using natural constituents, inorganic fiber, glass fiber, or a blend of any of the foregoing. By way of example only, synthetic fibers may include polyester, acrylic, polyamide, polyolefin, polyaramid, polyurethane, or blends thereof. More specifically, polyester may include polyethylene terephthalate, polytrimethylene terephthalate, polybutylene terephthalate, polylactic acid, or combinations thereof. Polyamide may include nylon 6, nylon 6,6, or combinations thereof. Polyolefin may include polypropylene, polyethylene, or combinations thereof. Polyaramid may include poly-p-phenyleneterephthalamide (i.e., Kevlar®), poly-m-phenyleneterephthalamide (i.e., Nomex®), or combinations thereof. Exemplary natural fibers include wool, cotton, linen, ramie, jute, flax, silk, hemp, or blends thereof. Exemplary man-made materials using natural constituents include regenerated cellulose (i.e., rayon), lyocell, or blends thereof.

The textile substrate of the present invention may be formed from staple fiber, filament fiber, slit film fiber, or combinations thereof. The fiber may be exposed to one or more texturing processes. The fiber may then be spun or otherwise combined into yarns, for example, by ring spinning, open-end spinning, air jet spinning, vortex spinning, or combinations thereof. Accordingly, the textile substrate will generally be comprised of interlaced fibers, interlaced yarns, loops, or combinations thereof.

The textile substrate may be comprised of fibers or yarns of any size, including microdenier fibers or yarns (fibers or yarns having less than one denier per filament). The fibers or yarns may have deniers that range from less than about 0.1 denier per filament to about 2000 denier per filament or, more preferably, from less than about 1 denier per filament to about 500 denier per filament.

Furthermore, the textile substrate may be partially or wholly comprised of multi-component or bi-component fibers or yarns in various configurations such as, for example, islands-in-the-sea, core and sheath, side-by-side, or pie configurations. Depending on the configuration of the bi-component or multi-component fibers or yarns, the fibers or yarns may be splittable along their length by chemical or mechanical action.

Additionally, the fibers comprising the textile substrate may include additives coextruded therein, may be precoated with any number of different materials, including those listed in greater detail below, and/or may be dyed or colored to provide other aesthetic features for the end user with any type of colorant, such as, for example, poly(oxyalkylenated) colorants, as well as pigments, dyes, tints, and the like. Other additives may also be present on and/or within the target fiber or yarn, including antistatic agents, brightening compounds, nucleating agents, antioxidants, UV stabilizers, fillers, permanent press finishes, softeners, lubricants, curing accelerators, and the like.

The printing process of the present invention uses a jet dyeing machine, or a digital printing machine, to place printing ink on the surface of the textile substrate (such as a carpet tile) in predetermined locations. One suitable and commercially available digital printing machine is the Millitron® digital printing machine, available from Milliken & Company of Spartanburg, South Carolina. The Millitron® machine uses an array of jets with continuous streams of dye liquor that can be deflected by a controlled air jet. The array of jets, or gun bars, is typically stationary. Another suitable and commercially available digital printing machine is the Chromojet® carpet printing machine, available from Zimmer Machinery Corporation of Spartanburg, South Carolina. A further additional digital printing machine that may be used is an inkjet digital printing machine for printing high resolution graphic designs onto carpet which allows it to print complex designs, also available from Milliken & Company of Spartanburg, South Carolina; this technology, also known as a multi-deflection inkjet system, is described for example, in U.S. Pat. Nos. 9,452,602 and 9,550,355. In one aspect, a tufted carpet made according to the processes disclosed in U.S. Pat. Nos. 7,678,159 and 7,846,214, both to Weiner, may be printed with a jet dyeing apparatus as described and exemplified herein.

Specifically with regard to suitable tufting machines and various types of tufted textile substrates created therefrom are those available from tufting machine manufacturers such Card-Monroe Corporation of Hixson, Tennessee, and includes exemplary technologies such as ColorPoint™ and Tailored Loop tufting.

The present invention allows for the pre-determined placement of printing ink on the surface of a textile substrate via a digital printing machine based on the location of specific physical cues, such as areas of tufted yarns, areas of no tufted yarns, presence or absence of yarn color, luster, twist, and the like. FIG. 1 is a flow diagram that illustrates the general steps of the process. First, several components are provided that include a digital printing machine, a textile substrate that contains at least one physical cue, and a system for detecting the physical cue(s). Next, the detection system (such as a system of cameras) observes and identifies the physical cue(s) as the textile substrate moves on a conveyor belt in close proximity to the detection system.

The detection system then sends an electronic signal to the digital printing machine. The signal is interpreted by the digital printing machine, and based on pre-determined instructions, the machine prints a specific color in a specific amount in-register with the area that contains the observed physical cue(s). A printed textile substrate comprising unique patterns and/or designs is thus created.

As used herein, physical cues include any physical feature contained within a textile substrate and/or provided on the surface of a textile substrate that is detectable by an electronic mechanism (such as a camera or scanning system) and which presence thereof is reportable to a digital printing machine. For example, physical cues include, but are not limited to, variations in print composition (such as color variations), tufting density, yarn construction, yarn composition, and the like, and combinations thereof. Variations in yarn construction include differences in yarn height, yarn color, yarn luster, yarn twist, yarn cut, yarn loop, yarn denier, and the like, and combinations thereof. Variations in yarn composition include differences in the material comprising the yarn and any finishes applied thereto. Variations in yarn construction may include yarns having both loop pile and cut pile. Variations in yarn height include, for example, yarns having a first tuft height and a second tuft height, said first tuft height being greater than said second tuft height.

By providing the ability to print in this manner, the present invention results in printed textile substrates having heretofore never before achieved designs and/or patterns on the surfaces thereof. Physical cues are identified by a detection system, such as cameras or scanning technology, capable of identifying differences in the surface areas of the textile substrate. Electronic communication between the detection system and the digital printing machine provides information that instructs the machine to print or not to print on a specific area. When cameras, for instance, identify a physical cue (such as an area of high yarn tuft), electronic signals are sent to the digital printing machine to dispense printing ink in this location.

In one aspect of the invention, a textile substrate is comprised of tufted yarns, said tufted yarns forming at least two areas A1 and A2 within the textile substrate, said areas A1 and A2 each containing a tufted design, said area A1 containing a first tufted design TD1 and said area A2 containing a second tufted design TD2, said TD1 being different from TD2, said at least two areas A1 and A2 being further characterized by having one of the following: (a) a print composition on at least a portion of area A1, (b) a print composition on at least a portion of area A2, or (c) a print composition on a least a portion of both area A1 and area A2, wherein the textile substrate is designed to be affixed to a building surface. In one aspect, the textile substrate as described herein has a first tufted design TD1 and a second tufted design TD2 that are independently selected from and formed by variations in print composition, tufting density, yarn construction, yarn composition, and combinations thereof.

In a further aspect, variations in yarn height may include yarns having a first tuft height and a second tuft height, said first tuft height being greater than said second tuft height. The textile substrate in this arrangement may contain a print composition on at least a portion of the tufted yarns having a first height, and the tufted yarns having a second height may be substantially free from the print composition. Alternatively, the textile substrate may contain the print composition on at least a portion of the tufted yarns having a second height, and the tufted yarns having a first height may be substantially free from the print composition. In a further alternative, the textile substrate may contain the print composition on all of the tufted yarns having a first height and a second height. Differences in tuft height may be achieved with cut versus loop pile configurations and/or variable loop over cut (VLOC) pile configurations.

Referring to tuft height, in one aspect of the invention, the first tuft height may be at least 10% greater than the second tuft height, or the first tuft height may be from about 10% to about 100% greater than the second tuft height, or the first tuft height may be from about 10% to about 75% greater than the second tuft height, or the first tuft height may even be from about 10% to about 50% greater than the second tuft height.

With respect to print composition, area A1 of the textile substrate may contain a first print composition PC1 and area A2 may contain a second print composition PC2, wherein PC1 differs in composition from PC2. In this arrangement, PC1 may form a print pattern PP1 and PC2 may form a print pattern PP2, wherein PP1 differs from PP2. PC1 may differ in quantity applied to A1 from PC2 applied to A2. Alternatively, PC1 may differ in composition applied to A1 from PC2 applied to A2. Additionally, PC1 may differ in quantity and composition applied to A1 from PC2 applied to A2. In yet a further alternative, area A1 may contain a first print composition PC1 and area A2 may contain a second print composition PC2, wherein PC1 is the same composition as PC2. The print composition may be present in-register with the tufted yarns in A1, A2, or both A1 and A2 of the textile substrate. In yet a further aspect of the invention, a first base layer of print color may be applied to the surface of the textile substrate, followed by a second layer comprising PC1 and/or PC2. In this aspect, the invention is capable of providing more than one (e.g., two, three, four, etc.) layers of print ink to the surface of the textile substrate using detectable cues on the textile substrate to determine print instructions (e.g., where to place the ink, how much ink to apply, and the like).

With respect to tufted designs, the textile substrate may further comprise a third tufted design TD3 that differs from TD1 and TD2. TD3 may be distinguished from TD1 and TD2 by at least one of print composition, tufting density, yarn construction, and yarn composition. The textile substrate may further comprise at least one additional tufted design TD4 that differs from TD1, TD2, and TD3. TD4 may be distinguished from TD1, TD2, and TD3 by at least one of print composition, tufting density, yarn construction, and yarn composition.

As described herein, ink printing instructions are provided to the digital printing machine according to the detectable physical cues present on the surface of the textile substrate. In one aspect, the present invention includes the ability to utilize at least one area of physical cue on the surface of a textile substrate to electronically instruct a digital printing machine to apply (or not apply) printing ink to that area. Deposition of printing ink onto the surface of the substrate is determined by the location and/or presence of those physical cues. The machine is also able to adjust the amount of printing ink applied to those areas as well. For example, areas of high tuft (a physical cue) may have more ink deposited on their surfaces, while areas of low tuft (also a physical cue) may have less ink deposited thereon. Thus, by including at least one detectable cue in or on the textile substrate during the manufacture and/or finishing of the substrate and developing the technology to use that cue to elicit a print response from a digital printing machine, new patterns and designs for textile substrates are created. In one aspect, these new patterns and designs are created on the textile substrates in a one pass (one trip down the print range) manufacturing process.

EXAMPLES

The following examples further illustrate the subject matter described above but, of course, should not be construed as in any way limiting the scope thereof.

Figure 5B:
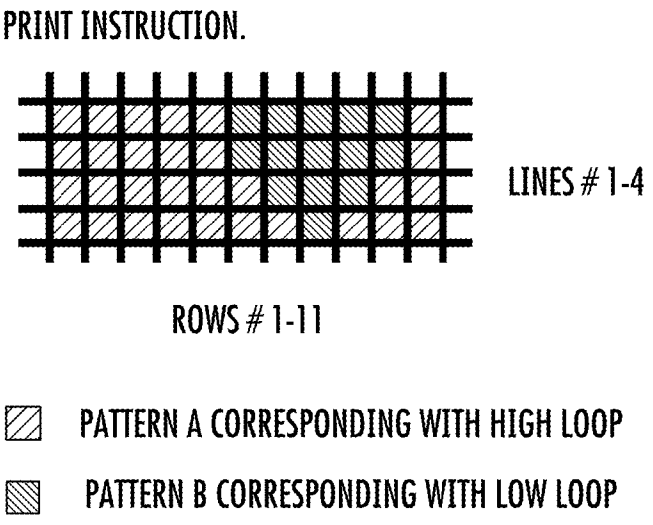
FIG. 5B is a schematic representation of the print pattern formed on the textile substrate of FIG. 5A based on the illustrated physical cues of high and low tuft loops.
Figure 5A:
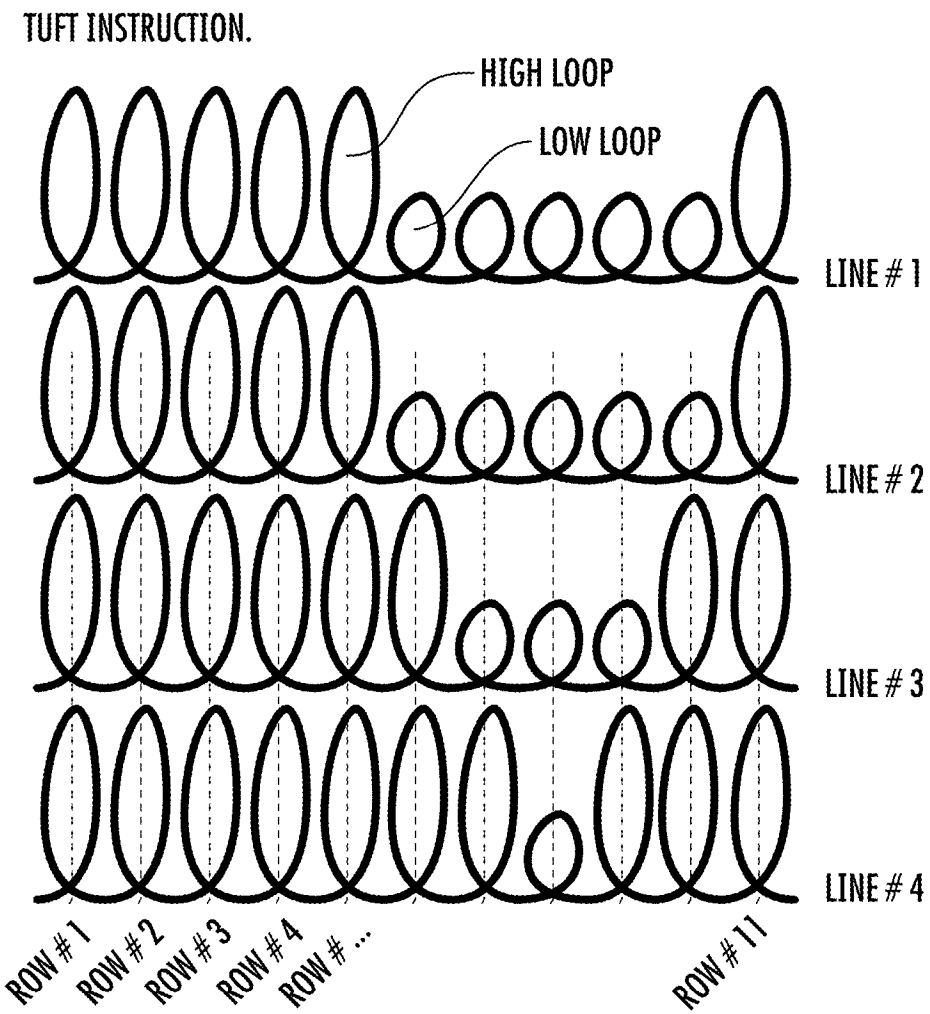
FIG. 5A is a schematic representation of one embodiment of a textile substrate having high and low tuft loops as exemplary physical cues according to the present invention.

FIGS. 5A and 5B illustrate a print in-register design on a textile substrate based on pile height differences as the physical cue for instructing the digital printing machine to apply printing ink only to the areas of low pile height ("low loop"). FIG. 5A is a cross-sectional view of a textile substrate having four lines of tufting and 11 rows of loops. FIG. 5B is a plan view of the textile substrate of FIG. 5A showing that a first printing ink was selectively applied only to the areas of high loop thereby creating printed Pattern A (area with high loops and printing ink), and a second printing ink was selectively applied only to areas of low loop thereby creating printed Pattern B (area with low loop and printing ink).

Figure 5C:
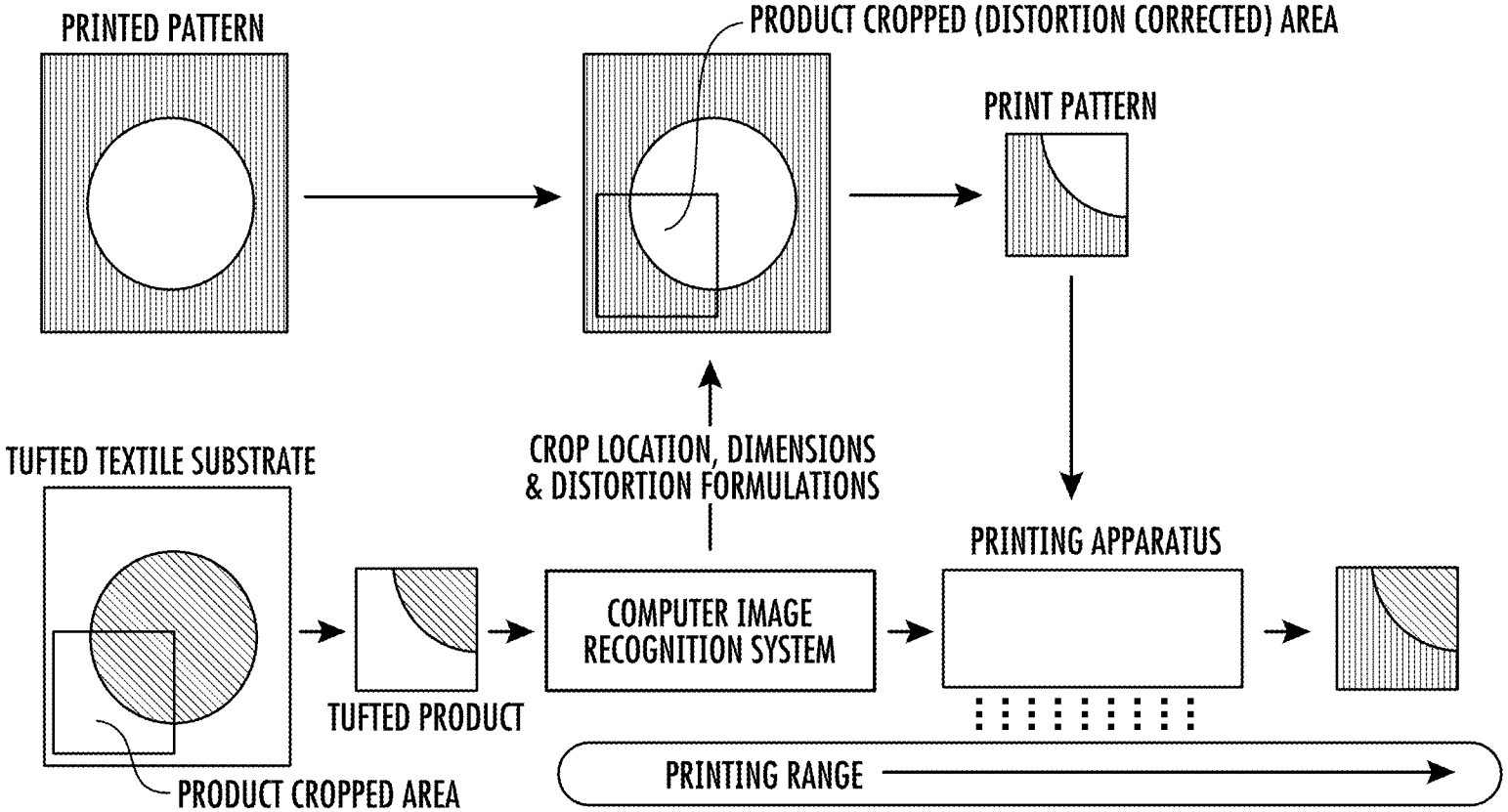
FIG. 5C is a schematic representation of an exemplary general process of the invention illustrating the combined features of printing in-register with physical cues on a textile substrate to form a unique pattern thereon.

FIG. 5C is provided to illustrate one aspect of the general process of the invention. A printed pattern on a textile substrate is shown that is corrected for distortion (if any) from the manufacturing and/or printing process. The printed pattern on the textile substrate is then exposed to a printing apparatus (such as a digital printing machine) provided in close proximity to a printing range. The printed pattern on the textile substrate moves along the printing range and receives additional printing ink in-register with pre-determined designated areas of the substrate, further adding another printed pattern to the textile substrate. FIG. 5C also illustrates a textile substrate having a tufted area. The tufted textile substrate is exposed to a computer image recognition system. If any distortion of the tufted textile substrate is detected, correction of the distortion occurs prior to exposure of the tufted textile substrate to the printing apparatus. After distortion correction is completed (if necessary), then the tufted textile substrate is exposed to the printing apparatus at the printing range. Printing of the tufted textile substrate takes place in-register to the pre-determined location of the tufts (i.e., the physical cues). A unique in-register printed and tufted textile substrate is then created having patterns and/or designs heretofore not achievable via prior art print technologies.

Figure 6:
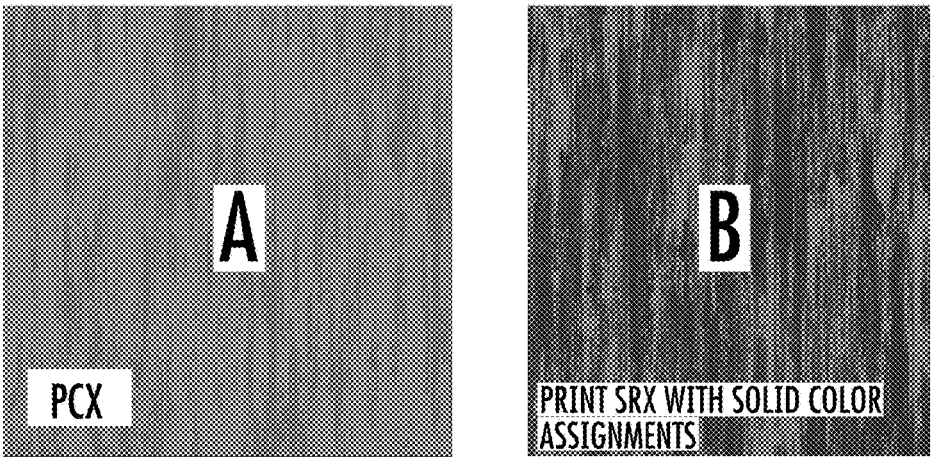
FIG. 6 is a grayscale photograph illustrating one embodiment of a printed floorcovering article according to the present invention, wherein a PCX file (Representation A) is layered with a print file (Representation B) to illustrate solid color placement based on tuft location.
Figure 7:
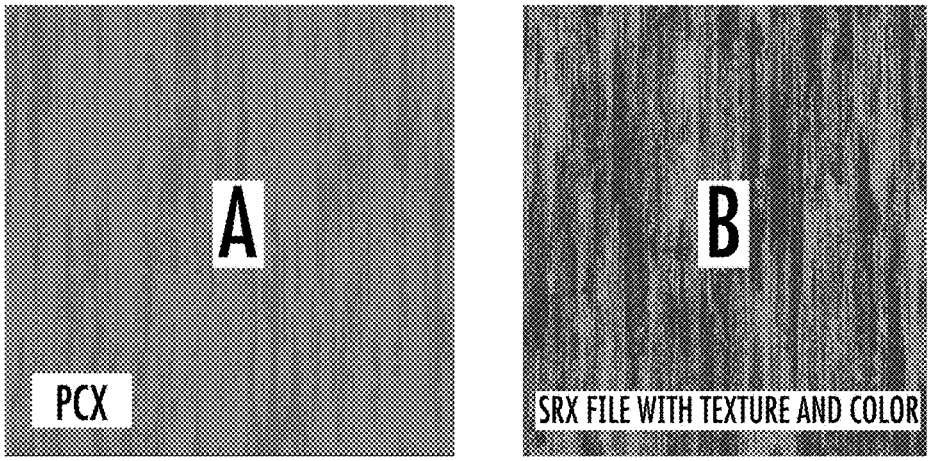
FIG. 7 is a grayscale photograph illustrating another embodiment of a printed floorcovering article according to the present invention, wherein a PCX file (Representation A) is layered with a print file (Representation B) to illustrate texture and color placement based on tuft location.

FIGS. 6 and 7 are provided to further illustrate the invention. FIGS. 6 and 7 are provided to illustrate tufted textile substrates with print overlay that is provided in-register with the tufted pattern. FIGS. 6 and 7 each contain Representation A and Representation B. In FIG. 6, Representation A is a picture exchange ("PCX") file that contains codes that represent pile heights on a tufting machine. The PCX file contains codes that represent pile heights on the tufting machine. The pile heights create a pattern when tufted. Representation B is a combination of Representation A with added feature of a print file that includes instruction for solid color placement. The print design matched a solid color to the PCX's file codes (pile setting). Printing was accomplished via the Millitron® digital printing machine.

In FIG. 7, Representation A is a PCX file that contains codes that represent pile heights on a tufting machine, while Representation B is a combination of Representation A with added feature of a print file that includes instruction for both texture and color placement. The print design matched a texture pattern and color to the PCX's file codes (pile settings).

The features of FIGS. 6 and 7 were prepared by importing the PCX file into digital design software and scaled to match the tufted scale. The PCX file was $12^{th}$ gauge so it was necessary to scale a $20^{th}$ gauge print SRX to match scale. For example, in a 744×1200 pixel PCX tuft file that is 12 stiches per inch in the width and 10 stiches, the finished tufted pattern will be 62 inches wide and 120 inches in the length. That same file in print will be 37.2 wide×60 inch in the length. The print file needs to be scaled to 1240×2400 pixels to match the tufted material.

Design Process A may be utilized when only solid color will be applied to match each code area of the tufted material. A print version file may be created. However, to apply a pattern/texture to the print design, the patterns or textures should be scaled to match the newly created SRX print file. Using the super impose function in digital design software, the selected pattern/textures will be added to the original code placements of the tuft pattern as is herein referred to as Design Process B.

The inventive samples shown in FIGS. 6 and 7 were produced via a manual process whereby tufted greige carpet tile was matched to the area in the full print design. A cropped portion of the main design was taken and printed onto the individual tile. It is contemplated that this manual process is also performed using hardware and software technology. In this regard, hardware and software components, for instance, in a production/manufacturing location, are capable of electronic and/or automatic detection of physical features on the textile substrate (e.g. a greige carpet tile). These components then can "scan" the greige material and find the corresponding area from the SRX print file to create the in-register printed textile substrate according to the present invention. The in-register printed textile substrate thus created contains unique designs and/or patterns heretofore unachievable and which are desired by designers and consumers in digital print industries for textile substrates.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the subject matter of this application (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the subject matter of the application and does not pose a limitation on the scope of the subject matter unless otherwise claimed. No language in the specification should be construed as indicating any non-claimed element as essential to the practice of the subject matter described herein.

Preferred embodiments of the subject matter of this application are described herein, including the best mode known to the inventors for carrying out the claimed subject matter. Variations of those preferred embodiments may become apparent to those of ordinary skill in the art upon reading the foregoing description. The inventors expect skilled artisans to employ such variations as appropriate, and the inventors intend for the subject matter described herein to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the present disclosure unless otherwise indicated herein or otherwise clearly contradicted by context.

We claim:

1. A process for creating a design on a textile substrate comprising the following steps:

(a) providing a textile substrate, wherein the textile substrate contains tufted yarns having a first height, tufted yarns having a second height, and areas free from tufted yarns, wherein the first height is greater than the second height;

(b) applying a first print design on a surface of the textile substrate in a pre-determined location, wherein the first print design is applied to the textile substrate via a digital printing apparatus, and wherein the first print design is applied to the textile substrate in only one of the following pre-determined locations on the textile substrate:

(i) on at least a portion of the tufted yarns having a first height, (ii) on at least a portion of the tufted yarns having a second height, (iii) on a least a portion of the areas free from tufted yarns, or (iv) on a least a portion of the tufted yarns having a first height and a second height;

(c) applying a second print design on the surface of the textile substrate, wherein the second print design is applied to the textile substrate via a digital printing apparatus, and wherein the second print design is applied to the textile substrate in only one of the following pre-determined locations on the textile substrate:

(i) on at least a portion of the tufted yarns having a first height, (ii) on at least a portion of the tufted yarns having a second height, (iii) on a least a portion of the areas free from tufted yarns, or (iv) on a least a portion of the tufted yarns having a first height and a second height; and (d) applying a third print design on the surface of the textile substrate, wherein the third print design is applied to the textile substrate via a digital printing apparatus, and wherein the third print design is applied to the textile substrate in only one of the following pre-determined locations on the textile substrate:

(i) on at least a portion of the tufted yarns having a first height, (ii) on at least a portion of the tufted yarns having a second height, (iii) on a least a portion of the areas free from tufted yarns, or on a least a portion of the tufted yarns having a first height and a second height.

2. The process of claim 1, wherein each of the first, second and third print designs are applied to the surface of the textile substrate in a single pass.

3. The process of claim 1, wherein each of the first, second and third print designs are applied simultaneously to the surface of the textile substrate.

* * * * *